US008882492B2

(12) United States Patent
Querejeta Andueza et al.

(10) Patent No.: US 8,882,492 B2
(45) Date of Patent: Nov. 11, 2014

(54) CONTROL SYSTEMS FOR THE IGNITION OF A GAS BURNER

(75) Inventors: Félix Querejeta Andueza, Vitoria-Gasteiz (ES); Gonzalo José Fernández Llona, Elorrio (ES); José Ignacio Múgica Odriozola, Bergara (ES); Francisco Javier Echenausia Saez de Zaitegui, Aretxabaleta (ES)

(73) Assignee: Coprecitec, S.L., Aretxabaleta (Gipuzkoa) (ES)

( * ) Notice: Subject to any disclaimer, the term of this patent is extended or adjusted under 35 U.S.C. 154(b) by 1045 days.

(21) Appl. No.: 12/791,264

(22) Filed: Jun. 1, 2010

(65) Prior Publication Data

US 2010/0255433 A1 Oct. 7, 2010

Related U.S. Application Data

(63) Continuation-in-part of application No. 12/508,448, filed on Jul. 23, 2009, which is a continuation-in-part of application No. 12/343,283, filed on Dec. 23, 2008, now Pat. No. 8,371,844.

(30) Foreign Application Priority Data

Oct. 2, 2008 (ES) ..... 200802834

(51) Int. Cl.
*F24C 3/10* (2006.01)
*F23Q 7/10* (2006.01)
*F23N 5/14* (2006.01)

(52) U.S. Cl.
CPC ..... *F23Q 7/10* (2013.01); *F23N 2035/18* (2013.01); *F23N 2027/42* (2013.01); *F24C 3/103* (2013.01); *F23N 2027/28* (2013.01); *F23N 5/146* (2013.01); *F23N 2035/14* (2013.01)
USPC ..... 431/12; 431/66; 431/67; 431/46; 431/71; 137/65

(58) Field of Classification Search
USPC ..... 431/12, 66, 24, 78; 361/247; 137/65
See application file for complete search history.

(56) References Cited

U.S. PATENT DOCUMENTS 2,430,373 A 11/1947 Strobel
3,144,898 A * 8/1964 Queever ..... 431/68

(Continued)

FOREIGN PATENT DOCUMENTS

WO WO9837367 A1 8/1998

*Primary Examiner* — Steven B McAllister
*Assistant Examiner* — Nikhil Mashruwala
(74) *Attorney, Agent, or Firm* — Tim L. Kitchen; Peter B. Scull; Hamilton DeSanctis & Cha, LLP.

(57) ABSTRACT

A system or apparatus that in one implementation includes an electromagnetic valve having an actuator rod with a first coil and a second coil positioned at different longitudinal locations on the actuator rod and being situated electrically parallel to one another in an electrical circuit. The electromagnetic valve is constructed to induce a first voltage in the second coil when the electromagnetic valve is in the open position and to induce in the second coil a second voltage lower than the first voltage when the electromagnetic valve is in the closed position. A switch changeable between a first position and a second position is located in the electrical circuit. When the switch is in the first position the electrical circuit is configured to allow current from a power source to be delivered to the second coil. When the switch is in the second position the electrical circuit is configured to not allow current from a power source to be delivered to the second coil. A control device situated in series with the second coil in the electrical circuit is adapted to detect the open or closed position of the first electromagnetic valve based on the induced voltage of the second coil. The control device is adapted to act upon the switch to change it between the first and second positions. In one implementation, upon detecting that the electromagnetic valve is in the closed position, the control device is configured to act upon the switch to cause it to assume the first position.

3 Claims, 7 Drawing Sheets

(56) References Cited

U.S. PATENT DOCUMENTS

| | | | | |
|---|---|---|---|---|
| 3,519,139 | A | 7/1970 | Brennan | |
| 3,597,139 | A * | 8/1971 | Elders | 431/66 |
| 3,826,605 | A | 7/1974 | Hantack | |
| 3,862,820 | A | 1/1975 | Hantack | |
| 4,002,419 | A * | 1/1977 | Hantack et al. | 431/67 |
| 4,306,853 | A | 12/1981 | Rippelmeyer | |
| 4,360,338 | A | 11/1982 | Katchka | |
| 4,529,373 | A * | 7/1985 | Ortlinghaus | 431/6 |
| 5,133,656 | A | 7/1992 | Peterson | |
| 5,889,645 | A | 3/1999 | Kadah et al. | |
| 6,322,352 | B1 * | 11/2001 | Zink | 431/27 |
| 6,332,352 | B1 | 12/2001 | Sano | |

* cited by examiner

CONTROL SYSTEMS FOR THE IGNITION OF A GAS BURNER

CROSS-REFERENCE TO RELATED APPLICATIONS

This application is a continuation-in-part of U.S. application Ser. No. 12/508,448 filed Jul. 23, 2009, which is a continuation-in-part of U.S. application Ser. No. 12/343,283 filed on Dec. 23, 2008, which claims priority to Spanish Patent Application No. P200802834, filed Oct. 2, 2008.

TECHNICAL FIELD

The present invention relates to control systems for the ignition of a gas burner, and more specifically to a burner used in domestic gas appliances such as cookers, driers and furnaces.

BACKGROUND

Different control systems for the ignition of a burner in domestic gas appliances are already known. In some of the systems an incandescent element or an igniter (a glowbar) is used for such a purpose. The incandescent element is disposed adjacent to the burner and is heated up to a temperature suitable for gas combustion, the incandescent element causing, when it reaches the temperature, the gas that reaches the burner to light.

U.S. Pat. No. 3,826,605 discloses a control system of this type, the control system comprising a thermoelectric valve to enable the passage of gas towards the burner. The thermoelectric valve comprises a bimetallic element and a resistive element that keeps the passage of gas closed at ambient temperature, this being opened when the bimetallic element is heated by the power supply current of the igniter. The choice of material of the elements and their arrangement is essential in ensuring the system functions correctly and that the valve does not open too early, for example, or open too late after the incandescent element has reached the combustion temperature. In addition, as it is dependent upon the temperature of the elements in order to close, the thermoelectric valve may remain open for a period of time after the command to switch off the burner has been sent, with gas reaching the burner during the period of time. In a second embodiment disclosed in the document, the control system also comprises an electromagnetic valve, it being necessary for both the thermoelectric and the electromagnetic valve to be open to enable the passage of gas. The thermoelectric valve continues to control the opening of the passage of gas, whereas the electromagnetic valve controls the closure of the passage.

SUMMARY OF THE DISCLOSURE

It is an object of the invention to provide a control system for the ignition of a gas burner, as described herein and as set forth in the claims.

The control system for the ignition of a gas burner in one implementation comprises at least one incandescent element that is designed to be heated until it reaches the gas combustion temperature and which is disposed adjacent to a burner in order to light the gas that reaches the burner, a power source for powering the incandescent element and thereby cause it to heat up, an electromagnetic valve to allow the passage of gas towards the burner, and an activation coil associated to the electromagnetic valve in order to open the valve.

The control system also comprises an additional coil associated to the electromagnetic valve and disposed electrically in series with the incandescent element, the additional coil and the incandescent element forming a branch electrically parallel to the activation coil, the valve being closed when power no longer reaches the additional coil.

When the incandescent element reaches the gas combustion temperature and both coils are powered; the electromagnetic valve opens to allow the passage of gas to the burner. The burner may be switched off by preventing power from being supplied to the coils, and, as the electromagnetic valve is not dependent upon the temperature as it would be if it were a thermoelectric valve, the valve thus is closed preventing the passage of gas towards the burner.

As a result, the use of a thermoelectric valve is not necessary in order to control the point at which the passage of gas towards the burner is opened, the control being performed through the electromagnetic valve that also controls the point at which the passage is prevented. Thus, the control system requires fewer elements and may also be more compact.

In accordance with one embodiment, a control system for the ignition of a gas burner is provided that includes an electromagnetic valve having an open position and a closed position for controlling the flow of a gas to a burner, the electromagnetic valve having a first coil and a second coil, the electromagnetic valve configured to assume the open position to permit the flow of gas through the electromagnetic valve to the burner when a current that passes through the first coil reaches a first predetermined amount and when a current that passes through the second coil reaches a second predetermined amount; at least one ignition element for igniting the gas burner when the ignition element reaches a combustion temperature of the gas, the ignition element being disposed electrically in series with the first coil, the first coil and ignition element forming a first branch; an auxiliary electromagnetic valve having an open position and a closed position for controlling the flow of a gas to the burner, the auxiliary electromagnetic valve having a coil and being configured to assume the open position to permit the flow of gas through the auxiliary electromagnetic valve to the burner when a current that passes through the coil reaches a third predetermined amount, the flow of gas towards the burner being allowed when both the electromagnetic valve and the auxiliary electromagnetic valve are open; and a switch adapted to cause the second coil of the electromagnetic valve to be electrically in parallel to the first branch in a first position, or to cause the coil of the auxiliary electromagnetic valve to be electrically in parallel to the first branch, in a second position.

In accordance with another embodiment, a control system for the ignition of at least two gas burners is provided that includes a first electromagnetic valve having an open position and a closed position for controlling the flow of a gas to a first burner, the first electromagnetic valve having a first coil and a second coil, the first electromagnetic valve configured to assume the open position to permit the flow of gas through the first electromagnetic valve to the first burner when a current that passes through the first coil reaches a first predetermined amount and when a current that passes through the second coil reaches a second predetermined amount; at least one first ignition element for igniting the first gas burner when the first ignition element reaches a combustion temperature of the gas to be delivered to the first burner, the first ignition element being disposed electrically in series with the first coil, the first coil and first ignition element forming a first branch; a second electromagnetic valve having an open position and a closed position for controlling the flow of a gas to a second burner, the second electromagnetic valve having a third coil and a fourth coil, the second electromagnetic valve configured to assume the open position to permit the flow of gas through the second electromagnetic valve to the second burner when a current that passes through the third coil reaches a third predetermined amount and when a current that passes through the fourth coil reaches a fourth predetermined amount; at least one second ignition element for igniting the second gas burner when the second ignition element reaches a combustion temperature of the gas to be delivered to the second gas burner, the second ignition element being disposed electrically in series with the third coil, the third coil and second ignition element forming a second branch; an auxiliary electromagnetic valve having an open position and a closed position for controlling the flow of a gas to the first and second burners, the auxiliary electromagnetic valve having a coil and being configured to assume the open position to permit the flow of gas through the auxiliary electromagnetic valve to the first and second burners when a current that passes through the coil reaches a fifth predetermined amount, the flow of gas towards the first burner being allowed when both the first electromagnetic valve and the auxiliary electromagnetic valve are open, the flow of gas towards the second burner being allowed when both the second electromagnetic valve and the auxiliary electromagnetic valve are open; a first switch adapted to cause the second coil of the first electromagnetic valve to be electrically in parallel to the first branch in a first position, or to cause the coil of the auxiliary electromagnetic valve to be electrically in parallel to the first branch, in a second position; and a second switch adapted to cause the fourth coil of the second electromagnetic valve to be electrically in parallel to the second branch in a first position, or to cause the coil of the auxiliary electromagnetic valve to be electrically in parallel to the second branch, in a second position.

In accordance with another embodiment, a method for controlling the gas flow to a burner through an electromagnetic valve and an auxiliary electromagnetic valve is provided, each of electromagnetic valve and auxiliary electromagnetic valve having a normally closed position and an open position, the electromagnetic valve having a first coil and a second coil that control the position of the electromagnetic valve, the auxiliary electromagnetic valve having a coil that controls the position of the auxiliary electromagnetic valve, the first coil of the electromagnetic valve being disposed electrically in series with an ignition element that is positioned to ignite the burner when the temperature of the ignition element reaches a combustion temperature of the gas to be delivered to the burner, the first coil and the ignition element forming a branch, the method including delivering a first current through the branch to provide power to the first coil of the electromagnetic valve and to cause the ignition element to heat, and a second current to the second coil of the electromagnetic valve to cause the electromagnetic valve to open; and subsequently delivering a third current to the coil of the auxiliary electromagnetic valve to cause the auxiliary electromagnetic valve to open.

In accordance with another embodiment a system or apparatus is provided that comprises an electromagnetic valve having an actuator rod with a first coil and a second coil positioned at different longitudinal locations on the actuator rod and being situated electrically parallel to one another in an electrical circuit, the electromagnetic valve constructed to induce a first voltage in the second coil when the electromagnetic valve is in the open position and to induce in the second coil a second voltage lower than the first voltage when the electromagnetic valve is in the closed position; and a control device situated in series with the second coil in the electrical circuit and adapted to detect the open or closed position of the first electromagnetic valve based on the induced voltage of the second coil.

In accordance with another embodiment a system or apparatus is provided that comprises an electromagnetic valve having an actuator rod with a first coil and a second coil positioned at different longitudinal locations on the actuator rod and being situated electrically parallel to one another in an electrical circuit, the electromagnetic valve constructed to induce a first voltage in the second coil when the electromagnetic valve is in the open position and to induce in the second coil a second voltage lower than the first voltage when the electromagnetic valve is in the closed position; a switch located in the electrical circuit, the switch changeable between a first position and a second position, when the switch is in the first position, the electrical circuit is configured to allow current from a power source to be delivered to the second coil and when the switch is in the second position, the electrical circuit is configured to not allow current from a power source to be delivered to the second coil; and a control device situated in series with the second coil in the electrical circuit and adapted to detect the open or closed position of the first electromagnetic valve based on the induced voltage of the second coil, the control device adapted to act upon the switch to change it between the first and second positions, upon detecting that the electromagnetic valve is in the closed position, the control device configured to act upon the switch to cause it to assume the first position.

In accordance with another embodiment, a control system for the ignition of a gas burner is provided comprising a first electromagnetic valve and a second electromagnetic control valve disposed in series to one another, each of the first and second electromagnetic valves having an open position and a closed position for controlling the flow of a gas to the burner, the gas deliverable to the burner when the first and second electromagnetic valves are each in an open position, the gas not being deliverable to the burner when one of the first or second electromagnetic valves is in a closed position, the first electromagnetic valve having a first coil and a second coil, the first electromagnetic valve configured to assume the open position to permit a flow of gas through the first electromagnetic valve when a current that passes through the first coil reaches a first predetermined amount and when a current that passes through the second coil reaches a second predetermined amount, the second electromagnetic valve having a third coil and configured to assume the open position to permit a flow of gas through the second electromagnetic valve when a current that passes through the third coil reaches a third predetermined value; at least one incandescent element for igniting the gas burner when the incandescent element reaches a combustion temperature of the gas, the incandescent element being disposed electrically in series with the first coil, the first coil and incandescent element forming a first branch; and an activator comprising a switch and a control device, the control device configured to act upon the switch, the switch changeable from a first position to a second position, when the switch is in the first position the control device being electrically in series with the second coil to form a block with the second coil, the block being electrically parallel to the first branch, when the switch is in the second position the block forms a closed circuit and the third coil is electrically in parallel to the first branch.

In accordance with another embodiment, a method for controlling the gas flow to a burner through a first electromagnetic valve and a second electromagnetic control valve disposed in series to one another is provided, each of the first and second electromagnetic valves having an open position and a closed position for controlling the flow of a gas to the burner, the gas deliverable to the burner when the first and second electromagnetic valves are in an open position, the gas not being deliverable to the burner when one of the first or second electromagnetic valves is in a closed position, the first electromagnetic valve having a first coil and a second coil, the first electromagnetic valve configured to assume the open position to permit a flow of gas the first electromagnetic valve when power is supplied to the first coil and to the second coil, the first coil configured to hold the first electromagnetic valve in the open position by itself after the first electromagnetic valve has assumed the open position, the second electromagnetic valve having a third coil and configured to assume the open position to permit a flow of gas through the second electromagnetic valve when power is provided to the third coil, at least one incandescent element for igniting the burner when the incandescent element reaches a combustion temperature of the gas, the incandescent element being disposed electrically in series with the first coil, the first coil and incandescent element forming a first branch, an activator comprising a switch and a control device disposed in a circuit comprising the first coil, second coil, third coil and the incandescent element, the switch changeable from a first position to a second position by being acted upon by the control device, when the switch is in the first position the control device being electrically in series with the second coil to form a block with the second coil, the block being electrically parallel to the first branch, when the switch is in the second position the block forms a closed circuit and the third coil is electrically in parallel to the first branch, the method comprising: causing the switch to be in the first position to enable a power supply to deliver power to the first and second coils to place the first electromagnetic valve in the open position and to cause the incandescent element to heat; and upon or after the incandescent element reaches the gas combustion temperature, or after a predetermined amount of time, acting upon the switch by use of the control device to change the switch to the second position in order to provide power to the third coil to place the second electromagnetic valve in the open position and to deactivate power to the second coil.

These and other advantages and characteristics of the invention will be made evident in the light of the drawings and the detailed description thereof.

DETAILED DESCRIPTION

Figure 1:
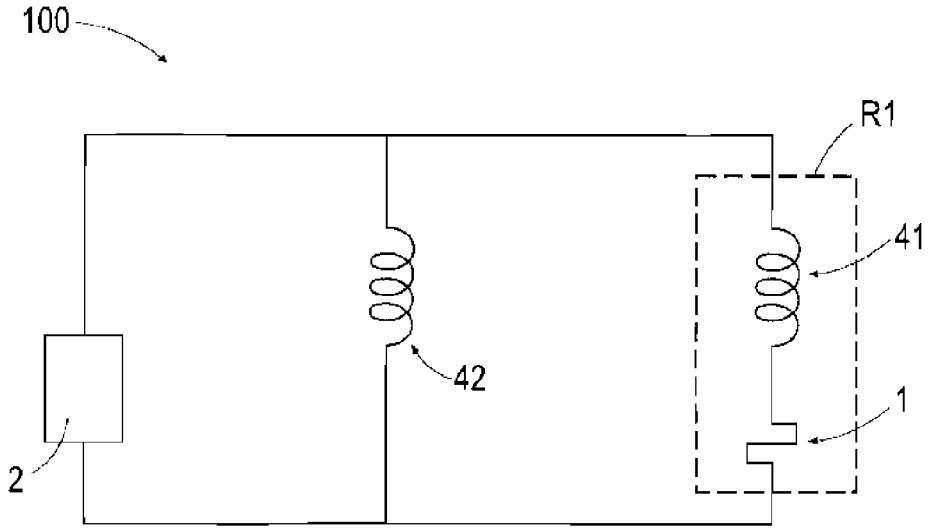
FIG. 1 schematically shows a first embodiment of a control system of the invention.
Figure 2:
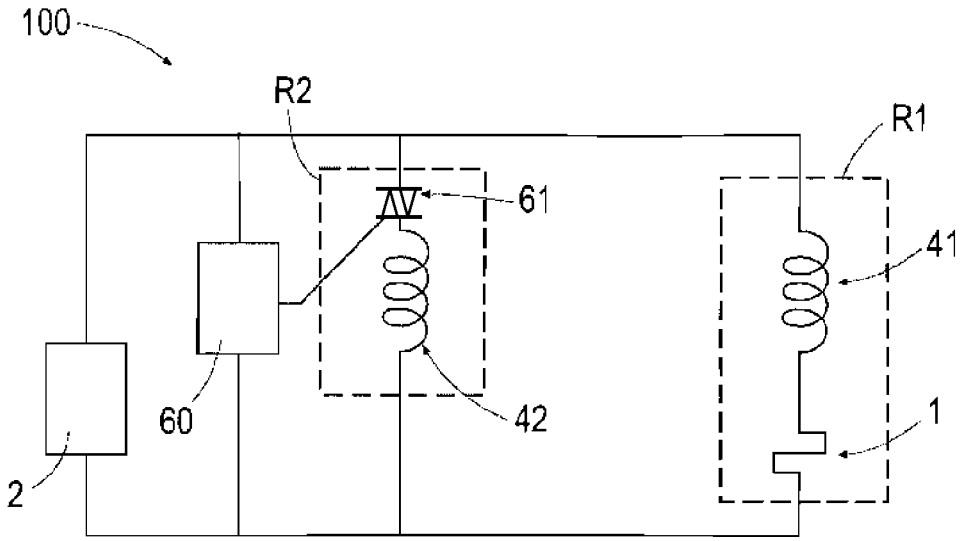
FIG. 2 schematically shows a second embodiment of a control system of the invention.
Figure 3:
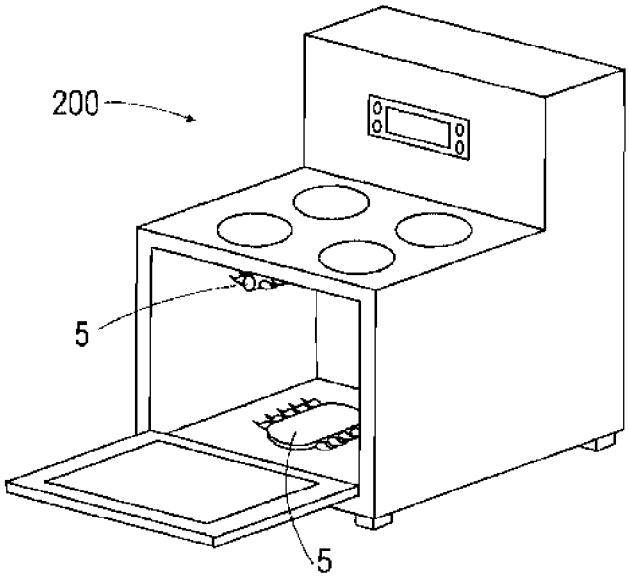
FIG. 3 is a perspective view of a domestic gas appliance where a control system of FIG. 1 or a control system of FIG. 2 may be used.
Figure 4:
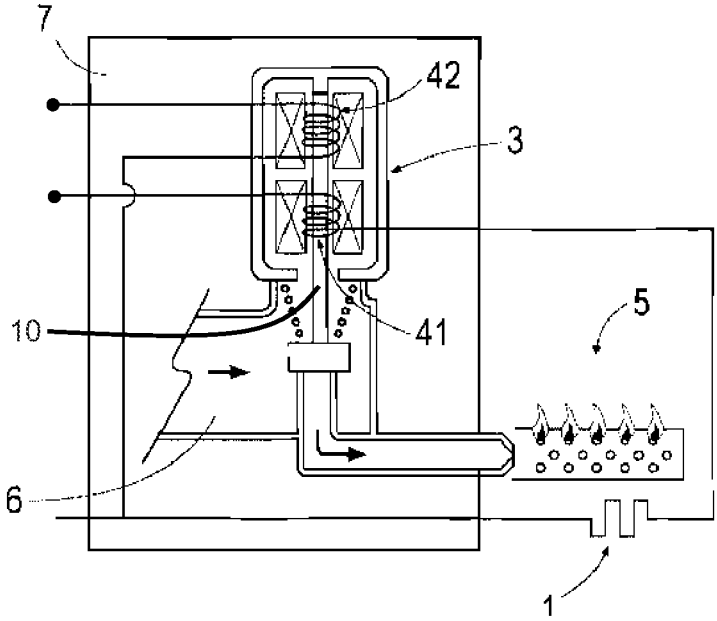
FIG. 4 shows a configuration of a control module of the domestic gas appliance of FIG. 3.

FIGS. 1 and 2 in combination with FIGS. 3 and 4 show embodiments of the control system 100 for the ignition of a gas burner according to different implementations, which preferably comprise at least one incandescent element or glow bar 1, which is designed to be heated until it reaches the gas combustion temperature and which is disposed adjacent to a gas burner 5, a power source 2 for powering the incandescent element 1 and thereby cause it to heat up, and an electromagnetic valve 3 for allowing or preventing the passage of gas to the burner 5, the incandescent element 1 causing the combustion of the gas when gas passes through the electromagnetic valve 3 and when the incandescent element 1 has reached the gas combustion temperature. The gas reaches the burner 5 from a fuel source (not shown in the Figures) through a fuel pipe 6, and the valve 3 allows the passage of gas through the pipe 6 from the fuel source to the burner 5 when it is open, or prevents the passage when it is closed.

The control system 100 is designed for domestic gas appliances 200, such as a cooker as shown in FIG. 3 or a drier (not shown in the Figures). The appliances 200 may comprise a single burner or a plurality of burners 5, the control system 100 preferably comprising, in the embodiments of FIGS. 1, 2 and 4, an incandescent element 1 and a valve 3 for each burner 5, the valve 3 being designed to allow or prevent the passage of gas to the corresponding burner 5, and the power source 2 being adapted in order to power and heat the incandescent elements 1. In the embodiments, the appliances 200 may also comprise, generally, a control circuit board (not shown in the Figures) by means of which the power of the burners 5 is controlled, for example, and through which the appliances 200 are powered. Thus, the power source 2 of the control system 100 is preferably disposed on the control circuit board.

In one embodiment, the electromagnetic valve 3 comprises a rod 10 upon which at least two coils 41 and 42 are wound. When the coils 41 and 42 are activated or powered with sufficient current, the rod 10 is moved, thereby opening the valve at the same time. Thus, in one embodiment, the control system 100 comprises activation coils 41 and 42 associated to the valve 3 in order to open the valve 3, the opening enabling the valve 3 to allow the passage of gas to the burner 5. As shown in the FIGS. 1, 2 and 4, coil 41 is disposed electrically in series with the incandescent element 1, the coil 41 and the incandescent element 1 forming a branch R1 electrically parallel to the activation coil 42. As a result, if the incandescent element 1 breaks down, the current stops circulating through the coil 41 due to the fact that it is disposed on the same branch as the incandescent element 1, and the valve 3 closes preventing the passage of gas to the burner 5.

In the embodiment of FIG. 1, the valve 3 is designed to open once the incandescent element 1 has reached the gas combustion temperature, the gas that reaches the burner 5 thus being lit, with the result that in order to open, it also depends on the current that passes through the coil 41, this being dependent on the temperature of the incandescent element 1. Thus, it is necessary that the current increases along with the temperature of the incandescent element 1. For example, in one embodiment the incandescent element 1 displays NTC (negative temperature coefficient) behaviour, in which the resistance of the incandescent element 1 reduces as its temperature increases, thus increasing the current that passes through the incandescent element 1 and, therefore, through coil 41.

The burner 5 may be switched off by turning off the power supply, thereby preventing power from being supplied to the coils 41 and 42, the valve 3 thus closing straightaway, preventing the passage of gas to the burner 5.

In the embodiment, the control system 100 may also operate without the activation coil 42, although the additional coil 41 would have to be adapted in order to allow it to open the valve 3 by itself, which would involve a much larger size of coil, preventing the obtaining of a compact control system 100 as is the case with the activation coil 42.

In a second embodiment shown in FIG. 2, the valve 3 is designed so that the additional coil 41 may keep the valve 3 open by itself but may not open it by itself. In order to light the burner 5, in a first moment power is supplied to the additional coil 41 and the incandescent element 1, but not the activation coil 42, it being necessary to power it afterwards in order to open the valve 3 and allow the passage of gas to the burner 5. In this case, the opening of the valve 3 depends, lastly, upon the activation coil 42, the use of a specific type of incandescent element 1 not being necessary, an incandescent element with NTC (negative temperature coefficient) or PTC (positive temperature coefficient) behaviour, or another type of behaviour, being capable of being used. For this purpose, the control system 100 comprises an activator to power the activation coil 42, powering it once the incandescent element 1 has reached the gas combustion temperature.

The activator preferably comprises a switch 61 disposed electrically in series with the activation coil 42, forming, along with the activation coil 42, a second branch R2 parallel to the branch R1 formed by the additional coil 41 and the incandescent element 1. In one embodiment, the switch 61 is normally open, preventing the activation coil 42 from being powered, and closing when the burner 5 is to be lit and the incandescent element 1 has reached the gas combustion temperature. The switch 61 preferably comprises a triac as shown in FIG. 2.

The activator may also comprise a control device 60 that acts on the switch 61 when a predetermined time equal to or greater than the time necessary for the incandescent element 1 to reach the gas combustion temperature has elapsed, the switch 61 allowing the activation coil 42 to be powered. This guarantees that the valve 3 opens when the incandescent element 1 has reached the gas combustion temperature.

The control device 60 acts on the switch 61, preferably by means of an activation pulse, the switch 61 allowing the activation coil 42 to be powered only during the activation pulse, given that the additional coil 41 may keep the valve open by itself. In addition, if the incandescent element 1 breaks down, for example, the additional coil 41 is no longer powered and as power is prevented from reaching the activation coil 42, the valve 3 closes so as to not allow the passage of gas to the burner 5. The control device 60 may also generate, for example, at least one additional pulse for the purposes of safety to ensure that the valve 3 has opened.

In the embodiments of FIGS. 1, 2 and 4, instead of a control device 60 and a triac, the activator may comprise, for example, a temperature sensor (not shown in the Figures) that activates the switch 61 when it detects that the incandescent element 1 has reached the gas combustion temperature, thus allowing power to be supplied to the activation coil 42, the valve 3 being opened.

In the embodiment, preferably, in order to switch the burner 5 off, the power supply is switched off, thereby preventing power from being supplied to the coil 41, the valve 3 thus closing straightaway, preventing the passage of gas to the burner 5.

In the embodiments of FIGS. 1, 2 and 4, the control system 100 may be comprised in the domestic gas appliance 200 in a variety of different arrangements. In a first arrangement shown in FIG. 4, a control module 7 comprises the electromagnetic valve 3 and the coils 41 and 42, the control module 7 comprising two power inputs through which the power supply reaches the additional coil 41 from the power source 2 which may be disposed on the control plate of the appliance 200, and an additional input for carrying the power supply to the activation coil 42, by means of the activator disposed, preferably, on the control circuit board of the appliance 200.

In a second arrangement not shown in the Figures, the appliance 200 may comprise a control module 7 that comprises the valve 3, the coils 41 and 42 and the activator. The control module 7 may comprise two power inputs through which the power supply reaches the coils 41 and 42 and the activator from the power source 2 which may be disposed on the control plate of the appliance 200.

In a third arrangement not shown in the Figures, the control module 7 comprises only the coils 41 and 42 and the switch 60 of the activator, the control module 7 comprising two or three power inputs through which the power supply reaches the coils 41 and 42 and the switch means from the power source 2 which may be disposed on the control plate of the appliance 200, and an additional input for carrying the activation pulse or the signal generated by the control means 60 to the switch means.

Figure 5:
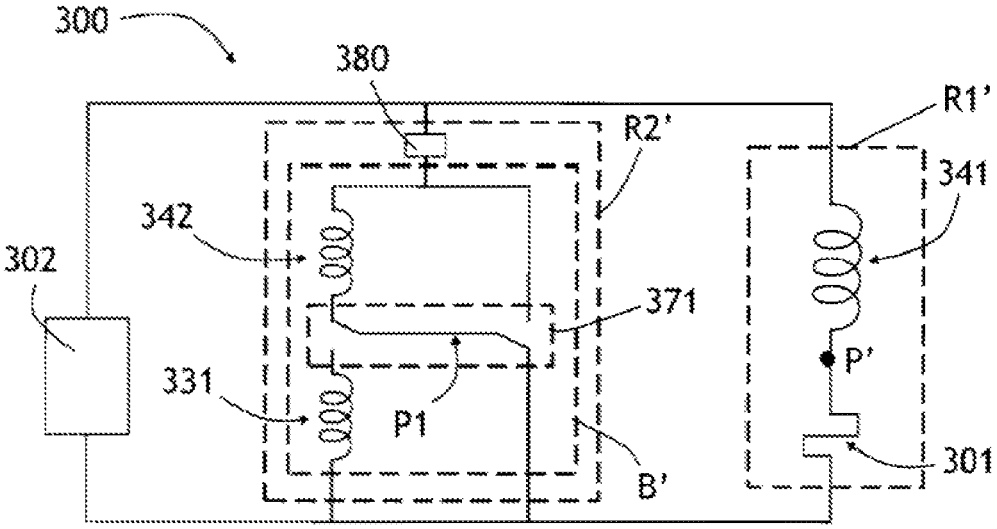
FIG. 5 schematically shows another embodiment of a control system having a switch disposed in a first position.
Figure 6:
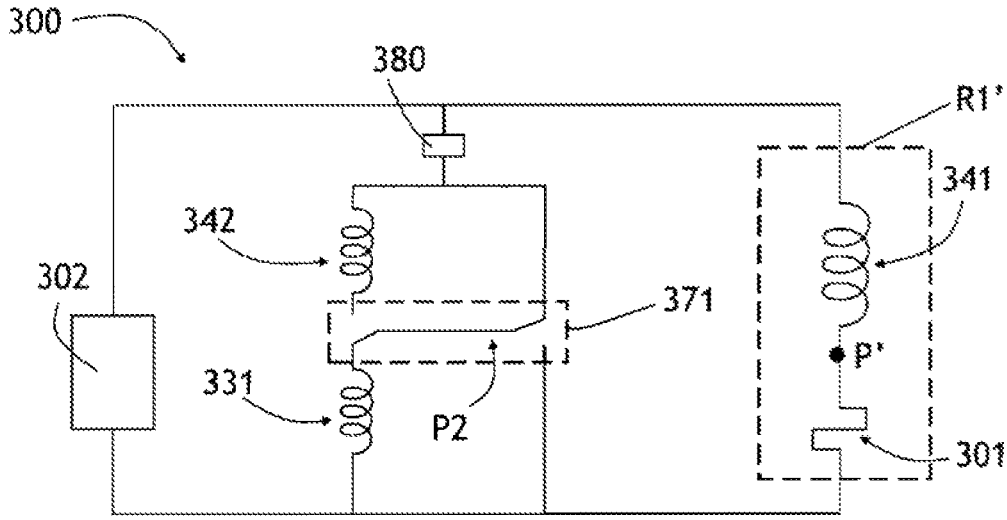
FIG. 6 shows the control system of FIG. 5 with the switch disposed in a second position.
Figure 7:
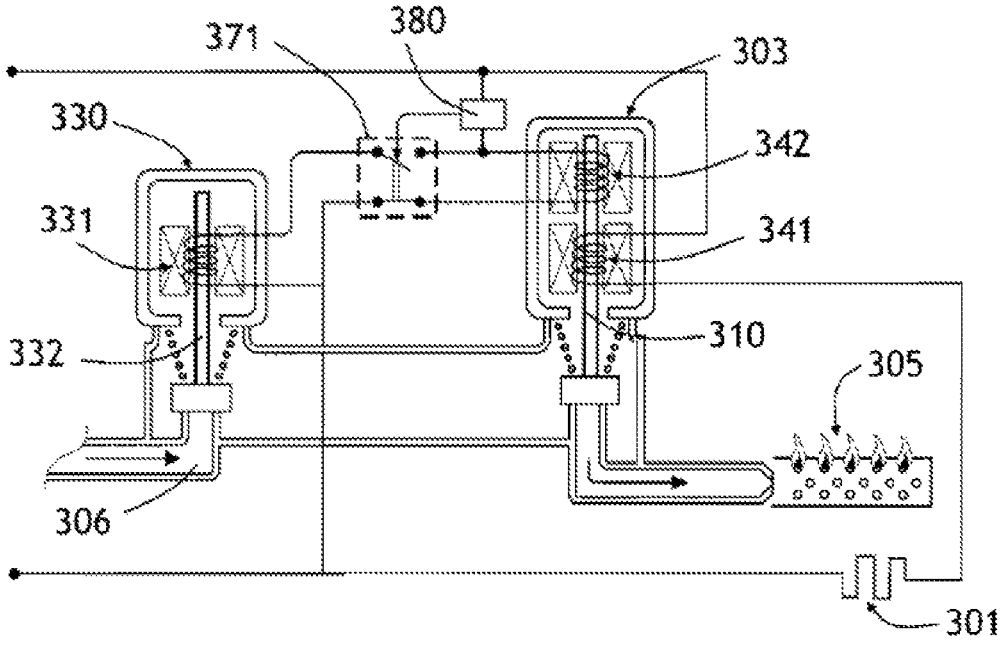
FIG. 7 shows a valve arrangement of a domestic gas appliance in one embodiment.

FIGS. 5 to 7 show other embodiments of a control system 300 for the ignition of a gas burner 305. Control system 300 includes a gas ignition element 301 positioned in proximity to a gas burner 305 and comprises one or more heating elements such as, for example, one or more incandescent elements or glow bars which are designed to be heated to a gas combustion temperature of a gas to be delivered to burner 305. In one embodiment, the control system 300 includes a power source 302, such as a transformer connected to a mains supply, for powering the control system 300 and which is used to cause an electrical current to pass through the ignition element 301 to cause it to heat. Control system 300 also includes an electromagnetic valve 303 and an auxiliary electromagnetic valve 330 for allowing or preventing the passage of gas to the burner 305, the ignition element 301 causing the combustion of the gas when gas passes through the electromagnetic valves 303 and 330 and when the ignition element 301 has reached the gas combustion temperature of the gas being delivered to burner 305. Gas is delivered to burner 305 from a fuel source (not shown in the Figures) through a fuel pipe 306 and the electromagnetic valves 303 and 330. As shown in FIG. 7, electromagnetic valves 303 and 330 are serially disposed in the gas flow path from the gas source and burner 305 and allow the passage of gas through the pipe 306 from the fuel source to the burner 305 when both valves 303 and 330 are open, or prevent the passage of gas when at least one of the valves 303 or 330 is closed.

In one embodiment, electromagnetic valve 303 has the same or similar configuration of the electromagnetic valve 3 of the previous embodiments described herein and comprises a rod 310 upon which at least two coils 341 and 342 are wound. When the coils 341 and 342 are activated or powered with sufficient current, the rod 310 is moved to cause the valve 303 to open to permit the flow of gas through the valve. The auxiliary electromagnetic valve 330 comprises a coil 331 and a rod 332 upon which the coil 331 is wound. When the coil 331 is activated or powered with sufficient current, the rod 332 is moved to cause the auxiliary electromagnetic valve 330 to open to permit a flow of gas through the valve. A flow of gas towards burner 305 is allowed when both the electromagnetic valve 303 and the auxiliary electromagnetic valve 330 are in an open position.

In the embodiment shown in FIGS. 5 and 6, the electromagnetic valve 303 is designed so that the first coil 341 may keep the electromagnetic valve 303 open by itself but may not open it by itself, powering of both the first coil 341 and the second coil 342 being necessary to open the electromagnetic valve 303. As discussed above, in order to provide gas flow to burner 305 it is also necessary to power the coil 331 of the auxiliary electromagnetic valve 330 in order to open the auxiliary electromagnetic valve 330. As shown in FIG. 5, in a first moment power is supplied to coils 341 and 342 to cause electromagnetic valve 303 to open, and also to the ignition element 301, but not to coil 331. Because coil 331 is not powered, valve 330 remains closed to impede the flow of gas towards burner 305. In this case, the allowance of the flow of gas towards the burner 305 depends, lastly, upon the activation of coil 331 which may occur anytime after the ignition element 301 reaches the gas combustion temperature of the gas to be delivered to burner 305. In this, and other embodiments, the use of a specific type of ignition element 301 is not necessary. For example, an incandescent element with NTC (negative temperature coefficient) or PTC (positive temperature coefficient) behaviour, or another type of behaviour, may be used.

Control system 300 includes an activator comprising a switch 371 that in a first position P1 is adapted to cause the second coil 342 of the electromagnetic valve 303 to be electrically in parallel to the branch R1' formed by the first coil 341 and the ignition element 301, as shown in FIG. 5. When in a second position P2, as shown in FIG. 6, the switch 371 is adapted to cause the coil 331 of the auxiliary electromagnetic valve 330 to be electrically in parallel to the branch R1'. In one embodiment, switch 371 is normally in the first position P1 when the ignition element 301 is initially powered to prevent the coil 331 from being powered. The switch 371 adapted to change to the second position P2 when the ignition element 301 has reached the gas combustion temperature of the gas to be delivered to burner 305 to permit the flow of gas to burner 305 and the ignition thereof. In one embodiment, switch 371 comprises a dual electromechanical relay.

As discussed above, in one embodiment switch 371 is normally in the first position P1 when power is initially supplied to the ignition element 301. In one embodiment the control system 300 further includes a control device 380 that is configured to act upon the switch 371 to take it to the second position P2 after a predetermined amount of time after power is supplied to the ignition element 301. In one embodiment, the time is pre-calculated to be sufficient for the ignition element 301 to reach the gas combustion temperature. The amount of time needed to reach a gas combustion temperature of a particular gas is generally substantially constant for ignition elements 301 exhibiting PTC behaviour. Further, depending on the power source, the amount of time to reach the gas combustion temperature is relatively short (e.g., in the range of about 5 to 15 seconds). On the other hand, the amount of time needed to reach a gas combustion temperature of a particular gas is generally variable and longer (e.g., in the range of about 30-60 seconds) for ignition elements 301 exhibiting NTC behaviour and will depend at least in part on the temperature of element 301 when it is initially powered. For this reason, an ignition element 301 that exhibits PTC behaviour is preferred, but not necessary.

In another embodiment, the control device 380 is configured to act upon the switch 371 to take it to the second position P2 when the current through the ignition element 301 has reached a predetermined value after power is initially supplied to it. For that purpose, in such an embodiment the control system 300 includes a current detection device incorporated within control device 380 or separately provided for detecting the current through the ignition element 301. In one embodiment, the current detection device is adapted to measure the voltage of a point P' between the ignition element 301 and the first coil 341 of the electromagnetic valve 303, and determines the current through the ignition element 301 by taking into account the measured voltage and the resistance of first coil 341.

In one embodiment control device 380 is disposed electrically in series with block B' formed by the switch 371, the second coil 342 of the electromagnetic valve 303 and the coil 331 of the auxiliary electromagnetic valve 330, so that the control device 380 and block B' form a second branch R2' that is electrically in parallel with branch R1'. In another embodiment, control device 380 is also disposed electrically in parallel to branch R1' and to block B'.

Figure 8:
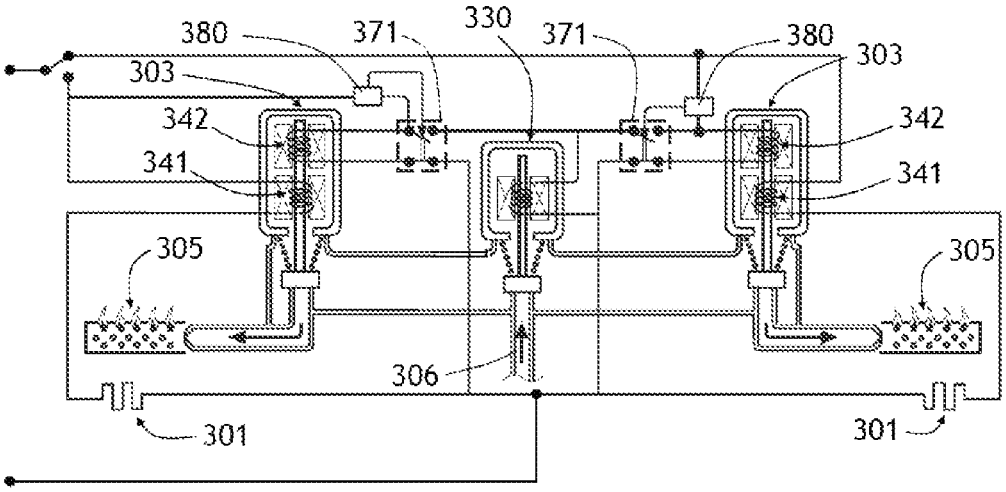
FIG. 8 shows a valve: arrangement of a domestic appliance in another embodiment.

In an embodiment where the appliance comprises two burners 305, such as that show in the appliance of FIG. 3 (e.g., one burner 305 for grilling and the other for baking), a variety of control system configurations is possible. In one arrangement each burner 305 has associated with it its own a control system 300. However, in another arrangement, as shown in FIG. 8, each burner 305 can comprise separate control systems similar to the embodiments of FIGS. 5 to 7 with the control systems having in common the auxiliary electromagnetic valve 330.

For the purpose of safety, in another embodiment the electrical characteristics of the second coil 342 of the electromagnetic valve 303 and of the coil 331 of the auxiliary electromagnetic valve 330 are dependent on each other, such that in a fault condition, if both coils 331 and 342 are electrically connected in series due to a short circuit for example, the current through them is not sufficient to open both the corresponding electromagnetic valve 303 and the auxiliary electromagnetic valve 330.

Figure 9:
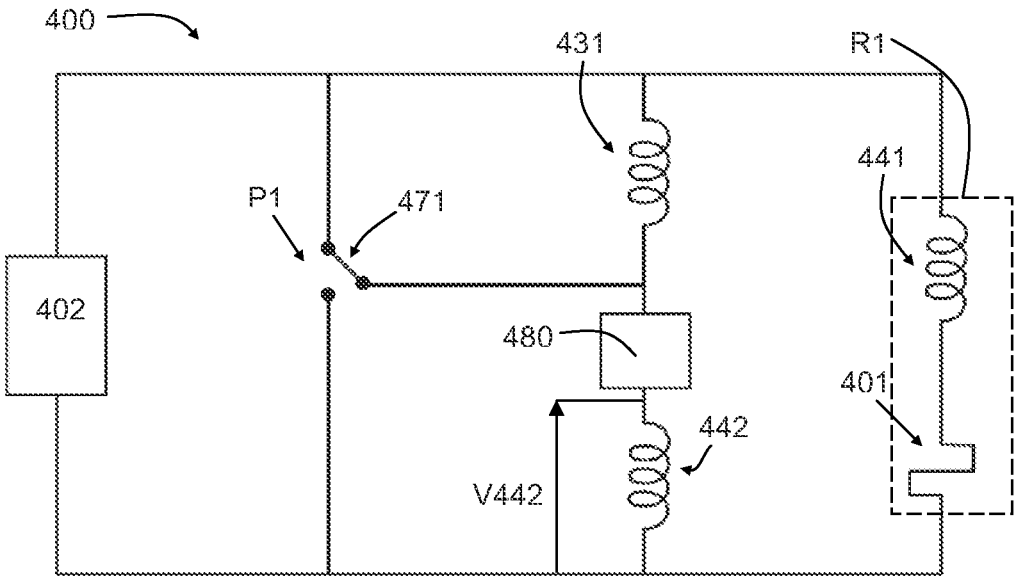
FIG. 9 schematically shows another embodiment of a control system having a switch disposed in a first position.
Figure 10:
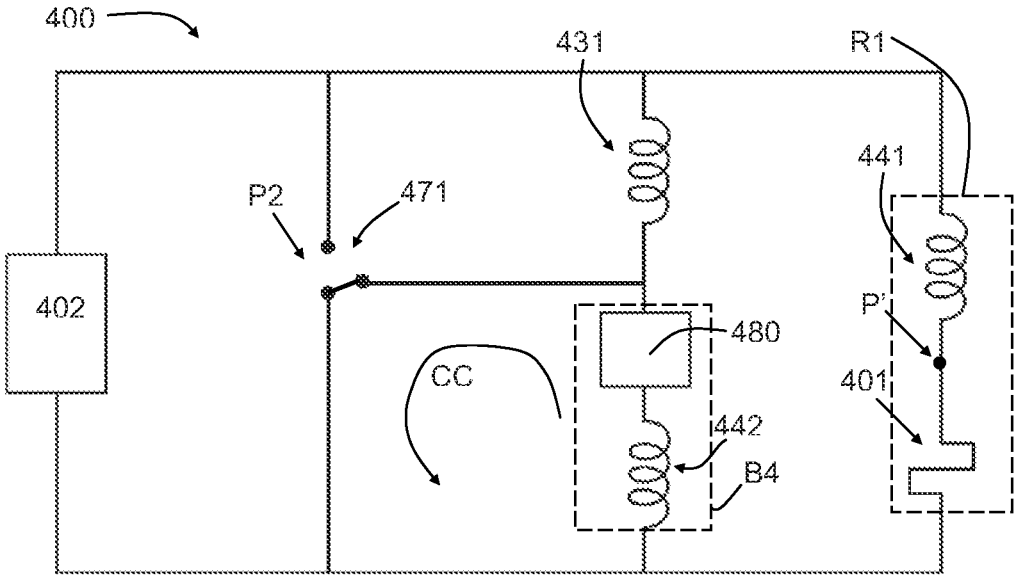
FIG. 10 shows the control system of FIG. 9 with the switch disposed in a second position.
Figure 11:
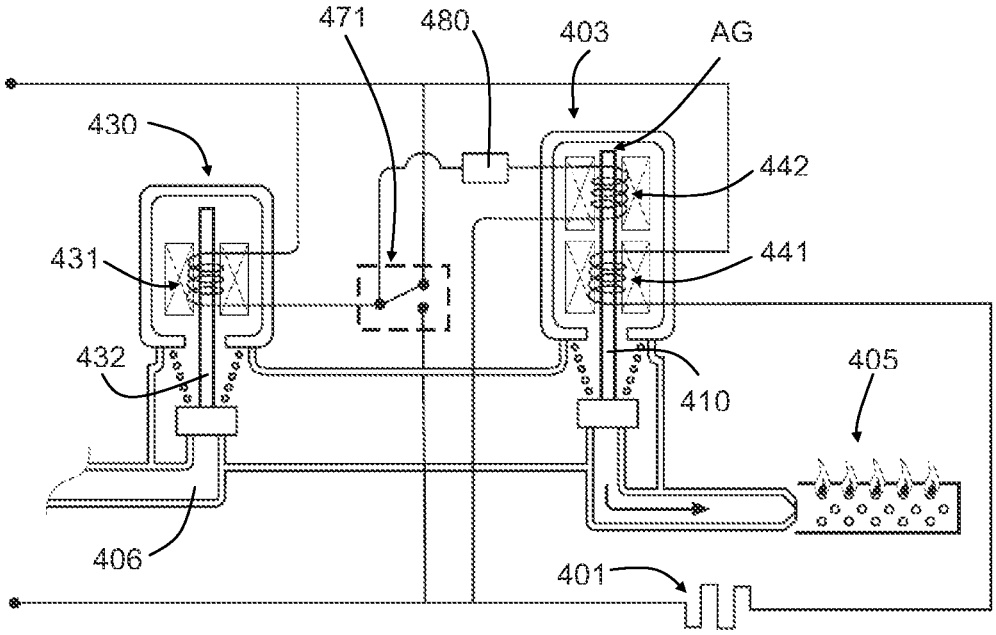
FIG. 11 shows a valve arrangement of a domestic appliance in another embodiment.

FIGS. 9 to 11 show other embodiments of control systems for the ignition of a gas burner. In accordance with one implementation, the control system 400 includes a gas ignition element 401 positioned in proximity to a gas burner 405 and comprises one or more heating elements such as, for example, one or more incandescent elements or glow bars which are designed to be heated to a gas combustion temperature of a gas to be delivered to burner 405. The control system 400 includes a power source 402, such as a transformer connected to a mains supply, for powering the control system 400 and which is used to cause an electrical current to pass through the ignition element 401 to cause it to heat. Control system 400 also includes an electromagnetic valve 403 and an auxiliary electromagnetic valve 430 for allowing or preventing the passage of gas to the burner 405, the ignition element 401 causing the combustion of the gas when gas passes through the electromagnetic valves 403 and 430 and when the ignition element 401 has reached the gas combustion temperature of the gas being delivered to burner 405. Gas is delivered to burner 405 from a fuel source (not shown in the Figures) through a fuel pipe 406 and the electromagnetic valves 403 and 430. As shown in FIG. 11, electromagnetic valves 403 and 430 are serially disposed in the gas flow path from the gas source and burner 405 and allow the passage of gas through the pipe 406 from the fuel source to the burner 405 when both valves 403 and 430 are open, or prevent the passage of gas when at least one of the valves 403 or 430 is closed.

The electromagnetic valve 403 has the same or similar configuration of the electromagnetic valves 3 and 303 of the previous embodiments described herein and comprises a rod 410 upon which at least two coils 441 and 442 are wound. When the coils 441 and 442 are activated or powered with sufficient current, the rod 410 is moved to cause the valve 403 to open to permit the flow of gas through the valve. The auxiliary electromagnetic valve 430 comprises a coil 431 and a rod 432 upon which the coil 431 is wound. When the coil 431 is activated or powered with sufficient current, the rod 432 is moved to cause the auxiliary electromagnetic valve 430 to open to permit a flow of gas through the valve. A flow of gas towards burner 405 is allowed when both the electromagnetic valve 403 and the auxiliary electromagnetic valve 430 are in an open position.

The electromagnetic valve 403 is designed so that the first coil 441 may keep the electromagnetic valve 403 open by itself but may not open it by itself, powering of both the first coil 441 and the second coil 442 being necessary to open the electromagnetic valve 403. As discussed above, in order to provide gas flow to burner 405 it is also necessary to power the coil 431 of the auxiliary electromagnetic valve 430 in order to open the auxiliary electromagnetic valve 430. As shown in FIG. 9, in a first moment power is supplied to coils 441 and 442 to cause electromagnetic valve 403 to open, and also to the ignition element 401, but not to coil 431. Because coil 431 is not powered, valve 430 remains closed to impede the flow of gas towards burner 405. In this case, the allowance of the flow of gas towards the burner 405 depends, lastly, upon the activation of coil 431 which may occur anytime after the ignition element 401 reaches the gas combustion temperature of the gas to be delivered to burner 405. The use of a specific type of ignition element 401 is not necessary. For example, an incandescent element with NTC (negative temperature coefficient) or PTC (positive temperature coefficient) behaviour, or another type of behaviour, may be used.

In one implementation control system 400 includes an activator comprising a switch 471, and a control device 480 that is configured to act upon the switch 471. When the switch 471 is in a first position P1 the control device 480 is electrically in series with the second coil 442 of the electromagnetic valve 403, forming a block B4, the block B4 being connected electrically in parallel to the power source 402 and to the branch R1 as shown in FIG. 9. When the switch 471 is in a second position P2, as shown in FIG. 10, the coil 431 of the auxiliary electromagnetic valve 430 is electrically in parallel to the branch R1 and the block B4 forms a closed circuit CC. In one embodiment, switch 471 is normally in the first position P1 when the ignition element 401 is initially powered to prevent the coil 431 from being powered. The switch 471 adapted to change to the second position P2 when the ignition element 401 has reached the gas combustion temperature of the gas to be delivered to burner 405 to permit the flow of gas to burner 405 and the ignition thereof. In one embodiment, switch 471 comprises a dual electromechanical relay.

As discussed above, in one embodiment switch 471 is normally in the first position P1 when power is initially supplied to the ignition element 401. In one embodiment the control device 480 is configured to act upon the switch 471 to take it to the second position P2 after a predetermined amount of time after power is supplied to the ignition element 401. In one embodiment, the time is pre-calculated to be sufficient for the ignition element 401 to reach the gas combustion temperature. The amount of time needed to reach a gas combustion temperature of a particular gas is generally substantially constant for ignition elements 401 exhibiting PTC behaviour. Further, depending on the power source, the amount of time to reach the gas combustion temperature is relatively short (e.g., in the range of about 5 to 15 seconds). On the other hand, the amount of time needed to reach a gas combustion temperature of a particular gas is generally variable and longer (e.g., in the range of about 30-60 seconds) for ignition elements 401 exhibiting NTC behaviour and will depend at least in part on the temperature of element 401 when it is initially powered. For this reason, an ignition element 401 that exhibits PTC behaviour is preferred, but not necessary.

In another embodiment, the control device 480 is configured to act upon the switch 471 to take it to the second position P2 when the current through the ignition element 401 has reached a predetermined value after power is initially supplied to it. For that purpose, in such an embodiment the control system 400 includes a current detection device incorporated within control device 480 or separately provided for detecting the current through the ignition element 401. In one embodiment, the current detection device is adapted to measure the voltage of a point P' between the ignition element 401 and the first coil 441 of the electromagnetic valve 403, and determines the current through the ignition element 401 by taking into account the measured voltage and the resistance of first coil 441.

Figure 12:
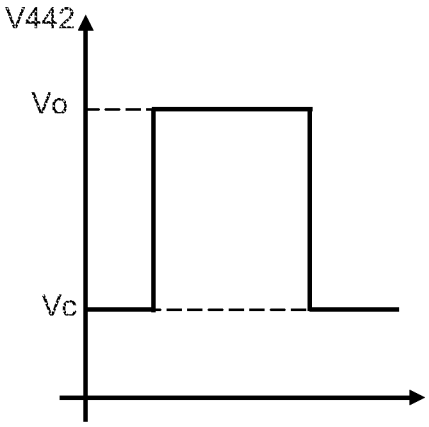
FIG. 12 shows exemplary induced voltages in a second coil of an electromagnetic valve.
Figure 13:
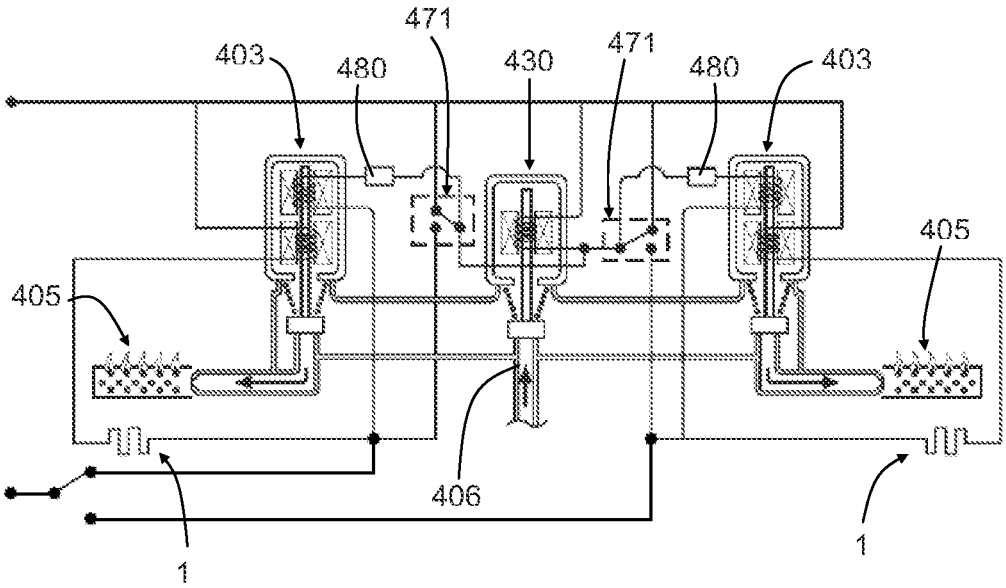
FIG. 13 shows a valve arrangement of a domestic appliance in another embodiment.

When the first coil 441 of the electromagnetic valve 403 is powered an induced force is generated, which causes an induction current through the second coil 442 of the electromagnetic valve 403, the second coil 402 comprising a voltage V442 due to the induced current through it. The value of the voltage V442 depends on if the electromagnetic valve 403 is open, allowing the flow of gas through it, or closed, impeding the flow of gas through it. When the electromagnetic valve 403 is closed an air-gap AG is present, and part of the induced force generated by the first coil 441 is lost in the air-gap AG, the induced current through the second coil 442 being smaller than when the electromagnetic valve 403 is open, situation in which no air-gap AG is present, and little or no induction force is lost. As the induced current through the second coil 442 is smaller, the voltage V442 is also smaller when the electromagnetic valve 403 is closed rather than when the electromagnetic valve 403 is open. FIG. 12 illustrates an example of this situation, the value Vo corresponding with the value of the voltage V442 when the electromagnetic valve 403 is open, and the value Vc corresponding with the value of the voltage V442 when the electromagnetic valve 403 is closed.

With the switch 471 in the second position P2, due to the closed circuit CC formed and due to the presence of the voltage V442 in the second coil 442 of the electromagnetic valve 403, the voltage in the control device 480 is equal to the voltage V442. Hence, if the voltage V442 changes due to a change in the position of the electromagnetic vale 403 (from an open position to a closed position or vice-versa), the voltage in the control device 480 is also changed, and the control means can determine that the electromagnetic valve 403 has changed its position. If an increase in the voltage V442 has occurred, then the control device 480 is able to determine that the electromagnetic valve 403 has been open, allowing the flow of gas through it, and if a decrease in the voltage V442 has occurred, then the control device 480 is able to determine that the electromagnetic vale 403 has been closed, impeding the flow of gas through it.

In the event that the power from the power supply 402 suffers a power-dip, the first coil 441 of the electromagnetic valve 403 loses power during the power-dip resulting in the electromagnetic valve 403 passing from an open position to a closed position. The input of conventional control device 408 typically includes a rectifier bridge and a filter (not illustrates in the Figures). The rectifier bridge is adapted for rectifying the alternating voltage from the power source 402, and the filter generally comprises at least one capacitor for filtering the rectified voltage coming from the rectifier bridge, the control device 480 being powered with the rectified voltage. This type of control device has the risk that, with the switch 471 in the second position P2, the control device 480 may not be able to determine the presence of a power-dip since as a result of the presence of the capacitor if the duration of the power-dip is short, the capacitor compensating momentarily for the loss of voltage so that the rectified voltage not affected. As a result, even though the electromagnetic valve 403 has closed due to the lack of power in the first coil 441 during the power-dip, the switch 471 is maintained in the second position P2 making it not possible to open again the electromagnetic valve 403.

This problem is solved in the control system 400 due to the closed circuit CC formed by the control device 480 and the second coil 442 of the electromagnetic valve 403. When the electromagnetic valve 403 is closed due to a power-dip, the voltage V442 in the second coil 442 of the electromagnetic valve 403 is changed causing the alternating voltage powering the control device 480 to also change along with the rectified voltage. As a result of the control device 480 being able to detect this voltage change, it may also then determine that the electromagnetic valve 403 has been closed and in response act upon the switch 471 to take it to the first position in order to permit the electromagnetic valve 403 to be opened again.

Another advantage of system 400 is that the control device 480 may also detect problems associated with the glow bar/igniter 401, such as whether it has been damaged or not by virtue of detecting a change in voltage V442. For example, if the igniter 401 is damaged, the branch comprising the first coil 441 of the electromagnetic valve 403 and the igniter 401 is opened, the first coil 441 not being powered with the result that the electromagnetic valve 403 is closed. The control device 480 detects this situation and takes the switch 471 to the first position P1 in order to power the first coil 441 and to open the electromagnetic valve 403. When the switch 471 is again taken to the second position P2 the control device 480 is able to detect that the voltage V442 does not correspond to a value indicative of the valve 403 being in an open position, determining then that the electromagnetic valve 403 has not been opened. As a result, a determination that the igniter 401 is possibly damaged may be made.

In an embodiment where the appliance comprises two burners 405, such as that show in the appliance of FIG. 3 (e.g., one burner 405 for grilling and the other for baking), a variety of control system configurations is possible. In one arrangement each burner 405 has associated with it its own a control system 400. However, in another arrangement, as shown in FIG. 14, each burner 405 can comprise separate control systems similar to the embodiments of FIGS. 9 to 11 with the control systems having in common the auxiliary electromagnetic valve 430.

Although the present invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. A system comprising:

an electromagnetic valve having an actuator rod with a first coil and a second coil positioned at different longitudinal locations on the actuator rod and being situated electrically parallel to one another in an electrical circuit, the electromagnetic valve constructed to induce a first voltage in the second coil when the electromagnetic valve is in the open position and to induce in the second coil a second voltage lower than the first voltage when the electromagnetic valve is in the closed position, the first and second voltages being induced by the first coil;

a control device situated in series with the second coil in the electrical circuit and adapted to detect the open or closed position of the electromagnetic valve based on the induced voltage of the second coil; and a switch located within the electrical circuit, the switch changeable between a first position and a second position, the control device adapted to act upon the switch to change it between the first and second positions, wherein when the switch is in the first position, the circuit is configured to allow electrical current from a power source to be delivered to the second coil and wherein when the switch is in the second position, the circuit is configured to not allow electrical current from a power source to be delivered to the second coil.

2. The system according to claim 1, wherein upon detecting that the electromagnetic valve is in the closed position, the control device is adapted to act upon the switch to change it to the first position.

3. A system comprising:

an electromagnetic valve having an actuator rod with a first coil and a second coil positioned at different longitudinal locations on the actuator rod and being situated electrically parallel to one another in an electrical circuit, the electromagnetic valve constructed to induce a first voltage in the second coil when the electromagnetic valve is in the open position and to induce in the second coil a second voltage lower than the first voltage when the electromagnetic valve is in the closed position;

a switch located in the electrical circuit, the switch changeable between a first position and a second position, when the switch is in the first position, the electrical circuit is configured to allow current from a power source to be delivered to the second coil and when the switch is in the second position, the electrical circuit is configured to not allow current from a power source to be delivered to the second coil; and a control device situated in series with the second coil in the electrical circuit and adapted to detect the open or closed position of the first electromagnetic valve based on the induced voltage of the second coil when the switch is in the second position, the control device adapted to act upon the switch to change it between the first and second positions, upon detecting that the electromagnetic valve is in the closed position the control device configured to act upon the switch to cause it to assume the first position.

* * * * *